United States Patent [19]

Edwards

[11] Patent Number: 5,069,263

[45] Date of Patent: Dec. 3, 1991

[54] PANEL INTERLOCK SYSTEM

[75] Inventor: Larry Edwards, Muscatine, Iowa

[73] Assignee: Hon Industries, Inc., Muscatine, Iowa

[21] Appl. No.: 476,797

[22] Filed: Feb. 8, 1990

[51] Int. Cl.[5] ..... A47G 5/00

[52] U.S. Cl. ..... 160/135; 52/36; 52/239

[58] Field of Search ..... 52/239, 36, 241, 282, 52/586, 632; 160/135

[56] References Cited

U.S. PATENT DOCUMENTS

| | | | |
|---|---|---|---|
| Re. 32,890 | 3/1989 | DeFouw et al. . | |
| 3,282,006 | 11/1966 | Halsey et al. . | |
| 3,327,440 | 6/1967 | Watkins . | |
| 3,430,997 | 3/1969 | Propst et al. . | |
| 3,766,696 | 10/1973 | Totoonchie . | |
| 4,035,972 | 7/1977 | Timmons . | |
| 4,047,342 | 9/1977 | Boulva . | |
| 4,458,461 | 7/1984 | Holley . | |
| 4,545,168 | 10/1985 | Dalton, Jr. . | |
| 4,557,091 | 12/1985 | Auer . | |
| 4,625,483 | 12/1986 | Zacky et al. . | |
| 4,716,692 | 1/1988 | Harper et al. . | |
| 4,716,699 | 1/1988 | Crossman et al. . | |
| 4,860,812 | 8/1989 | DePietro et al. | 52/239 X |

*Primary Examiner*—Robert W. Gibson, Jr.

*Attorney, Agent, or Firm*—Neuman, Williams, Anderson & Olson

[57] ABSTRACT

A panel interlock system for connecting a plurality of wall panels together is disclosed. A locking clip is attached to the vertical edges of each wall panel. A vertical filler tube is used to connect adjacent wall panels together. The vertical filler tube is disposed between wall panels and slid down over locking clips which engage inner grooves extending through the length of the vertical filler tube. The vertical filler tube engages the locking clips in a concealed cam-action fastening technique.

7 Claims, 5 Drawing Sheets

FIG. 13
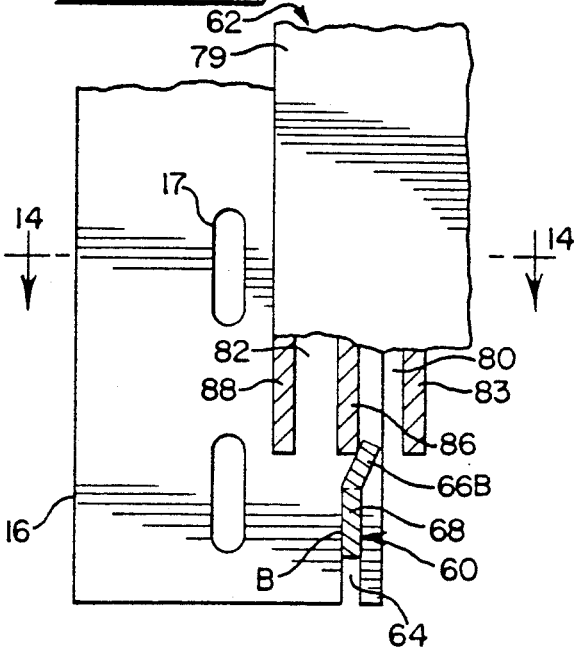
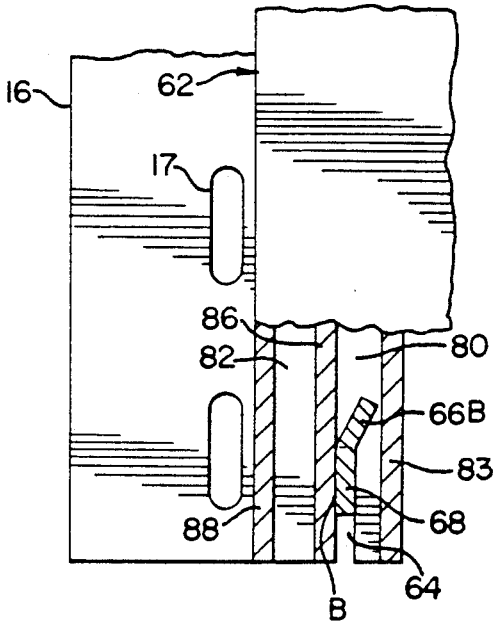
FIG. 15
FIG. 14
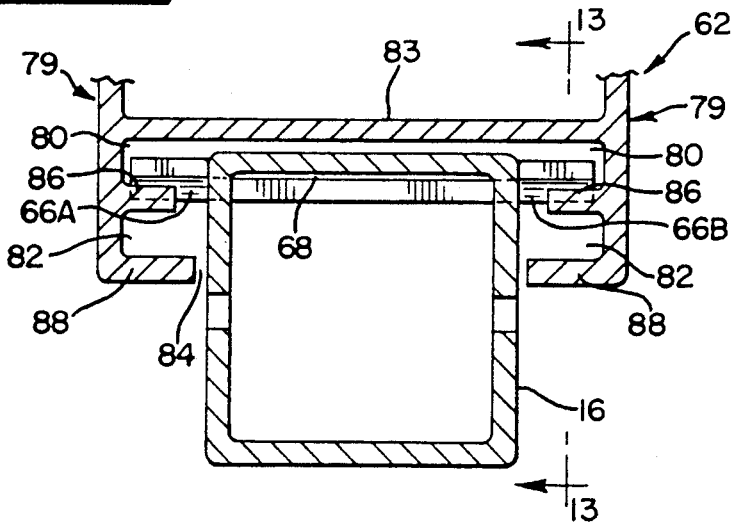

PANEL INTERLOCK SYSTEM

BACKGROUND OF THE INVENTION

1. Field of the Invention

This invention relates to the assembly and connection of panel systems to partition office or industrial space into work areas and more particularly to a panel interlock arrangement for connecting two or more panels together through the use of cammed clips attached to the vertical frame members of a panel and a vertical retaining post which engages the clips of each panel being interconnected to form a wall panel assembly.

2. Background

Different types of space divider systems are known in the prior art. Typically, one constructs a space divider system by interconnecting wall panel sections to form furniture arrangements which include desks, work area partitions, and office cubicle arrangements. These systems provide a convenient way to divide large interior office space into smaller work areas. The walls of such systems provide a more private and less noisy work environment than is otherwise available in open office spaces. The panels typically include a vertical row of slots on a post for mounting brackets for supporting shelves and the like.

Panels arrangements have become particularly useful in certain types of modern offices where the cost of construction walls to form individual offices may be prohibitive, or where it is desired to provide partitions of various heights, sizes add designs for aesthetic reasons. Moreover, with a higher frequency of offices being rearranged, reorganized or moved to other locations or buildings, it is highly desirable to be able to quickly assemble furniture and partitions to suit particular needs, and thereafter to be able to easily disassemble such arrangements and move them elsewhere.

Thus, much of the prior art illustrating space divider systems is directed towards the joining arrangement used to interconnect panels. A proper joining arrangement should securely and tightly join adjacent panels. The joining arrangement must include lateral and transverse stabilizing means. Because one frequently rearranges or moves the systems, it is also essential that the systems are easily assembled and disassembled.

Many known panel arrangements of the type used to construct office furniture, office partitions and similar structures suffer from deficiencies which limit the usefulness of such arrangements. One problem found in such arrangements is the difficulty often encountered in joining the individual panels to one another and, once joined, in thereafter easily separating the panels for rearrangement or relocation.

For example, one prior art system discloses a wall partition system in which the wall partitions are held together by a connector strip having a plurality outwardly and downwardly extending connectors for mating with corresponding upwardly and outwardly extending connectors attached to the vertical end sections on each of the opposing wall partitions. This system can be difficult to install because it requires the assemblies simultaneously to mate each of the pairs of connectors.

Other types of panel joining arrangement utilize bottom connectors and top connectors, which have a variety of designs. For example some systems use horizontal stiffening plates at the top and bottom to join adjacent panels. The bottom stiffening plate is difficult to install because it requires the assembler to make adjustment with tools at that low position. The bottom element may require that panels be turned upside down or in any event placed so as to afford access to the panel bottoms, a technique which has proven to be cumbersome considering the relatively substantial weight of many such panels and particularly in arrangements where a number of the panels are to be assembled into a particular complex.

SUMMARY OF THE INVENTION

It is an object of this invention to provide a joining arrangement which tightly secures adjacent panels and provides lateral and transverse stabilizing means. It is a further object that the system can be easily assembled and disassembled, particularly without requiring adjustments with tools at the bottom of the adjacent panels. The present invention achieves these objects in a unique and advantageous manner.

The joining arrangement of the present invention utilizes a unique cammed clip arrangement at the panel bottoms and a cooperating vertical retaining post for engaging the clips. The unique clip/post arrangement allows the assembler to quickly assemble the panels by directly placing the post onto the cammed clip, thereby providing lateral stability. The vertical retaining post further straddles the side edges of the adjacent panels to provide transverse stabilizing means between adjacent panels. A horizontal stiffening plate engages at the tops of the panels.

In particular, the panels of this invention have a vertical tube or piece welded or otherwise affixed to each side edge. The vertical tube may include a vertical row of slots for mounting brackets for supporting shelves and other components. The bottom of the vertical tube includes a cammed clip with two ear members. The clip is canted upward and outward from the panel along the edges at the bottom of the tube. The clip is bent to provide two surface portions at different angles. The top portion, the ear member, is canted from the line of the vertical tube, preferably greater than about 5° and less than about 40°. The bottom surface portion of the clip is parallel to the vertical post. The clips are also slightly recessed from the outward edge of the vertical tube.

The system further includes a vertical retainer post disposed between and straddling the edges of two adjacent panels. The post has a special I-shaped crosssection with grooves to engage the cammed clips. The vertical post engages the cammed clips in a concealed cam-action fastening technique. To interlock adjacent panels, the bottom of the vertical retainer post is slid down over the ear members of the clips of two adjacent slotted tubes. The canted ear members of the clips facilitate easier insertion of the post into the clip opening. The inner grooves of the retainer post engage the ear members and move down the cam and locking surfaces of the ear members. This draws the adjacent tubes against the vertical post by the cam action. The grooves continue moving down the ear members. The grooves then move past the bend in the clips to the less canted bottom portion. This bottom portion retains the groove with a more secure fit. In particular, the more vertical configuration of the bottom portion of the clip prevents movement due to lateral forces.

The post also straddles the edges of each vertical tube, thereby concealing the clips and the portions of the slotted tubes extending outward from the row of slots. Thus, only the row of slots remains exposed. Moreover, the straddling provides transverse stability between the panels. The top of the panels are interlocked by a conventional horizontal stiffening plate.

In this system, panels can be joined at different angles and configurations. For example, if panels are joined at a 90° angle, an additional corner joining arrangement is required. The corner joining arrangement contains vertical channels which surround the vertical spacing member. Vertical spacing members are permanently secured to a corner joining arrangement by screws. This entire assembly is then attached to panels by the flanges previously discussed.

BRIEF DESCRIPTION OF THE DRAWINGS

The foregoing and other objects, features and advantages of the invention will be apparent from the following more particular description of preferred embodiments of the invention, as illustrated in the accompanying drawings in which:

FIG. 13 is a partial view of one post, tube and clip assembly in the process of being joined, taken partially in sections as along line 13—13 of FIG. 14;

FIG. 14 is a cross-sectional view along line 14—14 of FIG. 13; and FIG. 15 is a view similar to FIG. 13 with the parts fully mated.

DESCRIPTION OF THE PREFERRED EMBODIMENT

Figure 1:
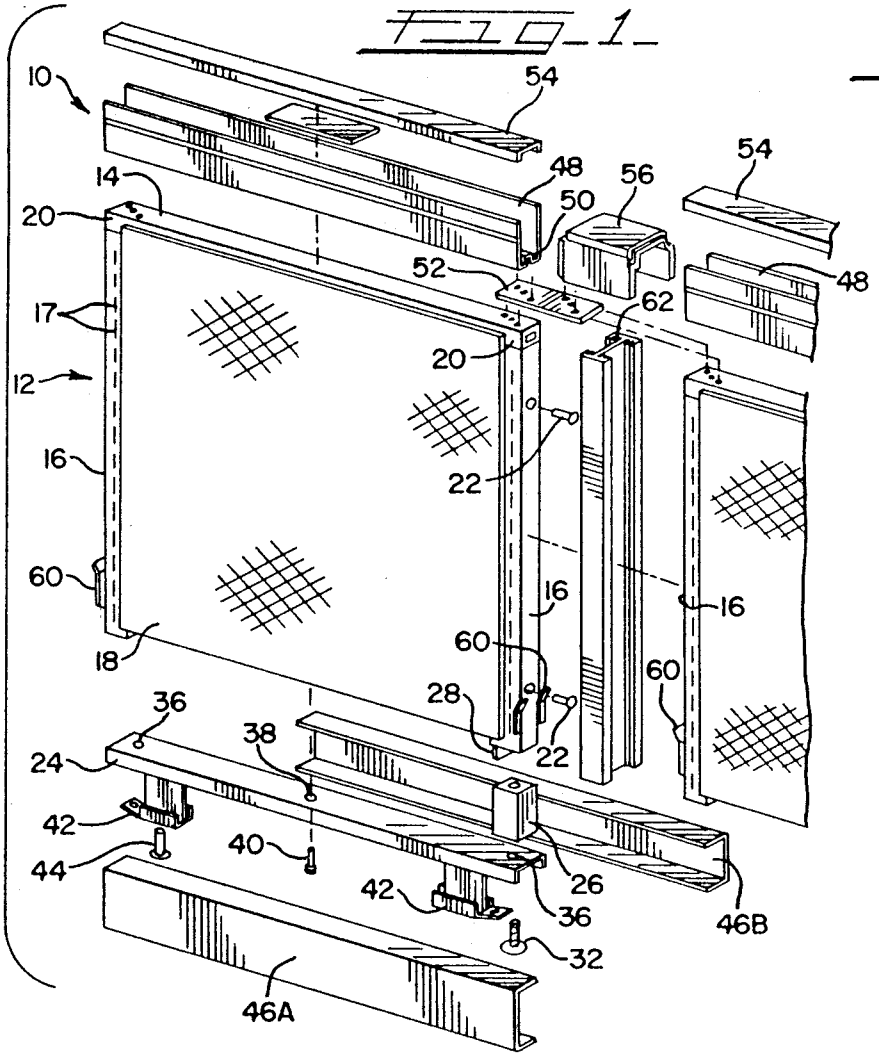
FIG. 1 is an exploded view of a linear joining arrangement of two panels in accordance with the present invention.

Referring now to FIG. 1, a final assembly wall panel 10 is shown in an exploded view. The present invention is used to join two or more of the final assembly wall panels 10 to form an office space divider system. The system includes partition members, such as the panels and vertical end caps. Each final assembly wall panel 10 includes a frame assembly 12 which consists of a horizontal tube 14, two vertical tubes 16 having mounting slots 17, and a panel 18. Each slotted vertical tube 16 is joined to an end 20 of the horizontal tube 14 at a 90° angle. In the preferred embodiment, the connection between the horizontal tube 14 and the slotted vertical tube 16 is made by a weld. The two slotted vertical tubes 16 and the horizontal tube 14 combine to form a frame which surrounds the panel 18. The frame is held in place around the panel 18 by a plurality of screws 22, two per each of the vertical slotted tubes 16 in this embodiment. As can be seen in FIG. 1, only two of the screws 22 are illustrated.

Figure 11:
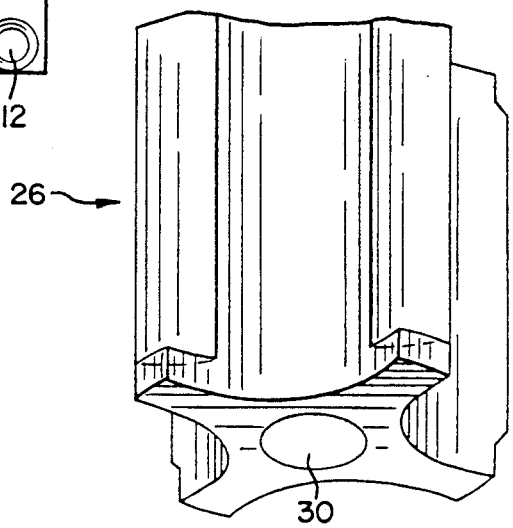
FIG. 11 is an alternative embodiment of the a base plug used in this invention.

At the bottom of the frame assembly 12, a base rail 24 is attached. A frame base plug 26 is press fit into the bottom of each of the vertical slotted tubes 16. The frame base plugs 26 are also used to hold a barrier strip 28 in each of the vertical slotted tubes 16. (Only one of the barrier strips 28 and one of the frame base plugs 26 is shown in FIG. 1.) Each frame base plug 26 contains a female threaded hole 30 whose location can be seen in another version of the frame base plug 26 shown in FIG. 11. The female threaded hole 30 of each of the frame base plugs 26 receives a frame base plug screw 32 used to attach the base rail 24 to the bottom of the frame assembly 12. Two of the frame base plug screws 32 are used to attach the base rail 24 to the frame assembly 12 through frame base holes 36. The frame base screw 32 extends through each of the frame base holes 36 into the female threaded hole 30 of the frame base plug 26. A third hole 38 receives a center screw 40 also used to attach the base rail 24 to the frame assembly 12.

The base rail 24 has two legs 42 each of which receives a leveler support 44 (one shown). The levelers 44 are adjustable to level the final assembly wall panel 10.

Provided on either side of the base rail 24 is a kick plate 46A and 46B which not only protects the base rail 24 from damage but provides appearance features as well. The kick plates 46A and 46B are held in place between the bottom of the frame assembly 12 and the top of the base rail 24 when the base rail 24 is attached to the frame assembly 12.

To complete the final assembly wall panel 10, a cableway base 48 is positioned above and parallel to the horizontal tube 14. The cableway base 48 includes a U-shaped channel 50 (not drawn to scale) which will encompass the horizontal tube 14 when the cableway base 48 is attached to the frame assembly 12. The cableway base 48 is attached to the horizontal tube 14 by a bracket 52 which is described later in greater detail. A cableway base top 54 is press fit on top of the cableway base 48 to prevent exposure of cables and wiring which can be located inside the cableway base 48. A cableway transition 56 is disposed between the cableway bases 48 and cableway base tops 54 of adjacent final assembly wall panels 10 to provide a transition between cableway bases 48.

FIG. 1 also shows the unique joining arrangement of this invention. Attached to each of the slotted vertical tubes 16 is a locking clip 60 which in cooperation with an in-line vertical retainer post 62 provides for simple, quick, and efficient mating of the two adjacent wall panels 10.

Figure 2:
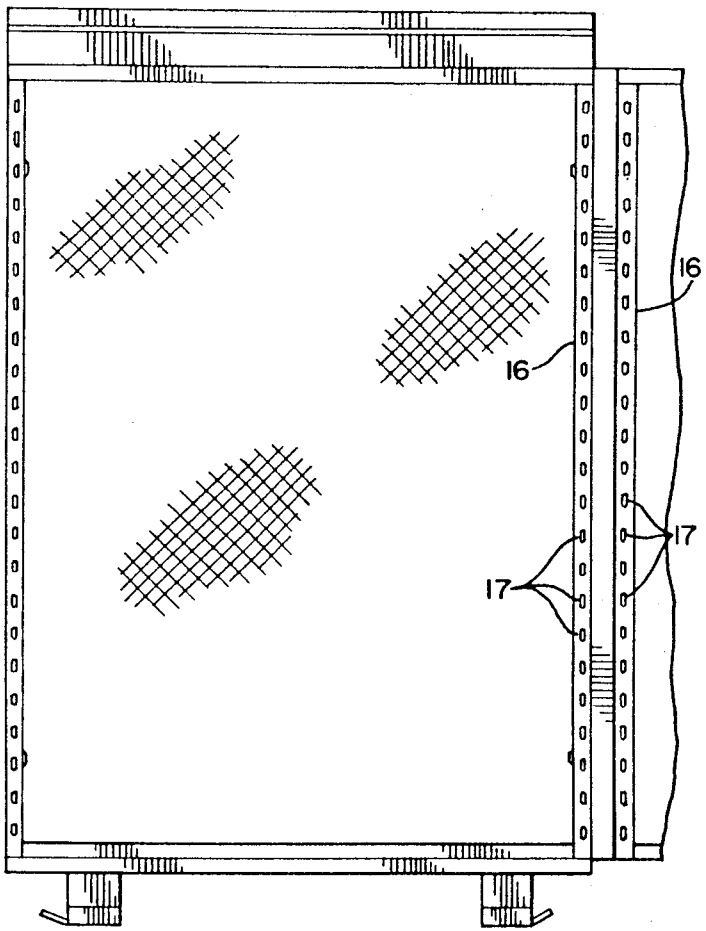
FIG. 2 is a frontal partial view of the panels of FIG. 1 upon joinder of the panels.

FIG. 2 illustrates the mated combination of two of the final assembly wall panels 10 joined together in an in-line fashion without a cableway base 48, a cableway base top 54 or cableway transition 56. The vertical tubes 16 of the adjacent panels each includes a row of vertical slots 17. The slots remain exposed when the assembled wall panels are joined. One can mount brackets on the slots for supporting shelves and other components.

Figure 7:
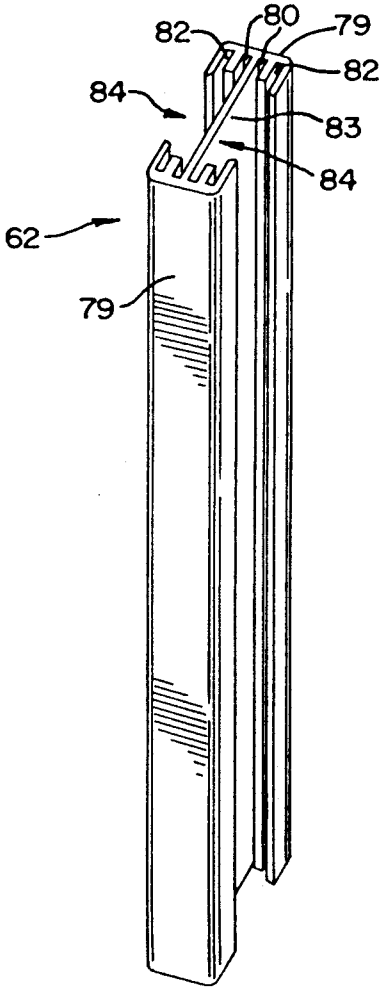
FIG. 7 is a perspective view of the vertical retaining post of, FIG. 1.

FIG. 7 illustrates the unique in-line vertical retainer post 62 of this invention. As seen in FIG. 7, the in-line vertical retainer post 62 has special I-shaped cross-section useful for engaging the locking clip 60 and the slotted vertical tubes 16. The post 62 has opposite end sections 79, each having an inner longitudinal groove 80 and an outer longitudinal groove 82 disposed on either side of the central vertical web 83 and defining open side channels 84 therebetween. The grooves 80 and 82 may be defined by return flanges 86, 88 and web or aperture 83, as shown in FIGS. 13–15. The vertical retainer post 62 and its grooves interact with the vertical tubes 16 and clips 60 as will be described below.

Figure 4A:
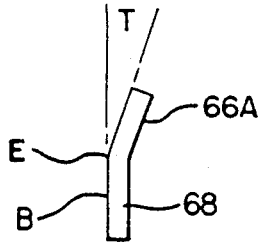
FIG. 4*a* is a cross-sectional view of the clip of FIG. 4 taken along line 42—42.
Figure 4B:
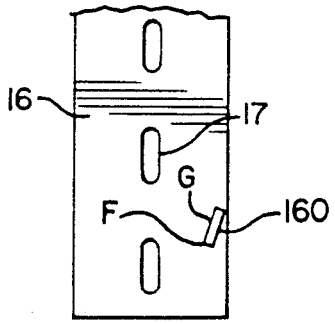
FIG. 4*b* is a side view of the bottom of a vertical tube with an alternative clip.
Figure 3:
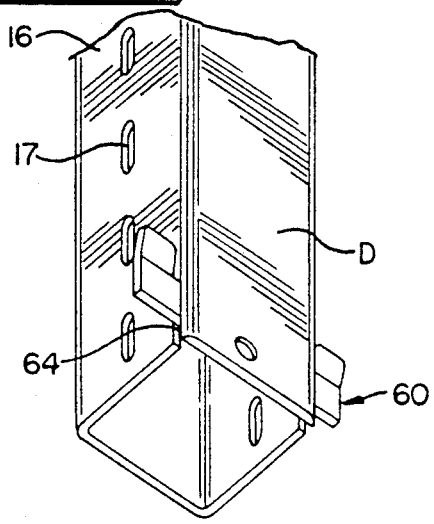
FIG. 3 is a perspective view of the bottom of the vertical tube on the left panel of FIG. 1
Figure 4:
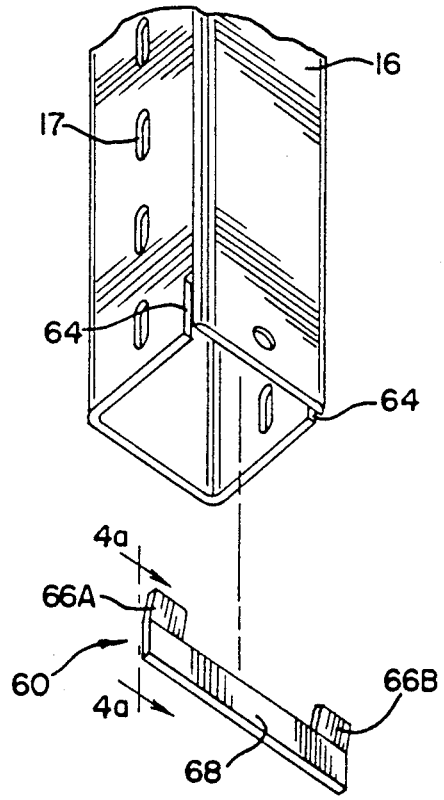
FIG. 4 is a perspective view of the vertical tube and clip of FIG. 3 before the clip is secured in place.

FIGS. 3 and 4 illustrate the bottom structure of the slotted vertical tube 16 and the locking clip 60 attached thereto. A locking clip slot 64, more easily seen in FIG. 4, is formed or cut along the bottom of the exposed vertical face of the slotted vertical tube 16 on assembled panel 12. The locking clip slot 64 extends upwardly into the slotted vertical tube 16 a sufficient depth to fully encompass the locking clip 60. The locking clip 60 is welded in place in the interior of the slotted vertical tube 16.

The structure of the locking clip 60 can be seen in FIG. 4. The locking clip 60 has two ears 66*a* and 66*b* extending from a horizontal bar or base section 68. Each of the ears 66 is canted slightly to be exposed upward and outward relative to the vertical center line of the tube 16. These ears provide the points of connection between the locking clip 60 and the in-line vertical retainer post 62 once assembled.

The configuration of the clip is very important to the joining arrangement. The configuration must provide a sufficient cam action and a secure engagement once the vertical retainer post is in place.

As shown in FIGS. 4*a* and 13–15, at the top of the clip, the ears 66 are canted outward and upward relative to the vertical center plane of the vertical tube 16. In the embodiment shown, the ears are canted about 12° from the vertical (shown as Angle T in FIG. 4*a*). This angle provides a sufficient cam action when the vertical retainer post is forced over the clip. Greater angles perform less efficient camming when the post is forced over the clips. The camming action must be sufficient to draw the adjacent panels together. Thus preferably, the angle T is less than approximately 40°. The angle is also preferably greater than 5°. With an angle of less than 5°, the clip would perform little work in drawing the two panels together. Most preferably, the angle T is between about 10° and 20°. Of course, it is not necessary that the ears are straight. A curved surface having a portion with a suitable degree of cant is contemplated by this invention.

As further shown in FIG. 4*a*, the horizontal bar 68 of this embodiment is parallel to the vertical center plane of the vertical tube 16. However, the bar 68 could be canted with the ears 66. Preferably, the bar is canted less than the ears 66. The horizontal bar 68 engages the grooves of the vertical retainer post in mating interlocking relationship when the panels are joined. The grooves engage the surface of horizontal bar 68 in direct lateral abutment when the grooves reach point E as shown FIG. 4*a*. Thus, the flat, substantially vertical surface of the horizontal bar 68 shown at B in FIG. 4*a* prevents the post and the tube from separating when lateral forces are exerted on the system. If the bar 68 is canted too much, such as 60° from the vertical line, the post and the tube could more easily separate when undesired lateral forces are exerted on the panel, particularly during assembly of a system. Thus, the surface B of the bar 68 provides a lock against inadvertent separation. The angle of the cant of the plane of surface B to the vertical is thus preferably less than 20°, and most preferably 0°. The surface B could also be canted slightly inward to provide an even greater locking engagement.

FIG. 4*b* illustrates a locking clip 160 in another embodiment. The locking clip 160 only includes two ear portions, one of which is shown. A similar ear portion would be disposed on the opposite side of the post 16. The ears are welded directly to post 16 and extend perpendicularly from the side surface of the post. The ear includes at least two surfaces. A cam surface is shown at G in FIG. 4*b*. The ear further includes a second surface shown at F. Unlike surface G, when the post engages surface F, it is in direct lateral abutment with the clip, thereby providing a locking arrangement against lateral forces.

Figure 5:
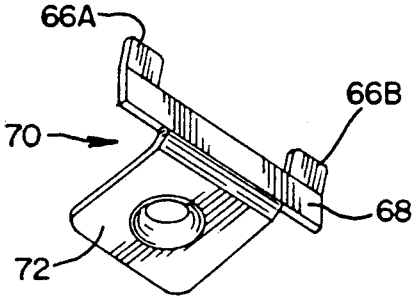
FIG. 5 is a perspective view of an alternative clip for insertion at the bottom of a vertical tube.

FIG. 5 illustrates a locking clip 70 in another embodiment. The locking clip 70 has ears 66*a*, 66*b* and a horizontal bar 68 which are the same as on the locking clip 60; but clip 70 also includes a mounting bracket 72 formed at a right angle from the horizontal bar 68. The different structure of the locking clip bracket 70 provides further rigidity.

Figure 6:
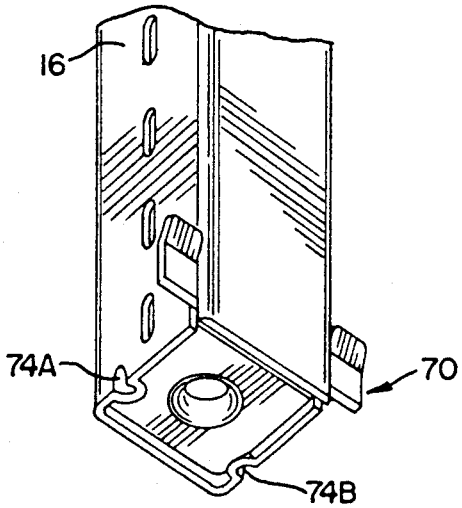
FIG. 6 is a perspective view of the bottom of a vertical tube with the clip of FIG. 5 secured in place.

FIG. 6 illustrates the attached position of the locking clip bracket 70 when mated with the slotted vertical tube 16. Once the locking clip bracket 70 is placed in position, the bottom ends of the slotted vertical tube are dimpled inward to create a first dimple 74A and a second dimple 74B. The placement of the dimples 74A and 74B keeps the locking clip bracket 70 in place. To ensure complete stability of the locking clip bracket 70 within the slotted vertical tube 16, a spot weld is made on each of the two sides of the slotted vertical tube 16 which do not have ears.

Turning to FIGS. 1 and 13–15, the clip and the vertical retainer post are joined in the following manner. As discussed, the ears 66 of the locking clip 60 are canted slightly to be exposed outward relative to the slotted vertical tubes 16 and upward. Each channel 84 is large enough to encompass the respective adjacent edge portion of a slotted vertical tube 16 when properly in place. When two of the final assembly wall panels 10 are to be joined, the post 62 is disposed between and straddles the edges of the adjacent vertical tubes 16, as best seen in FIG. 14. The inner longitudinal grooves 80 of the post 62 are slid down over the top of each of the locking clips 60 of the two adjacent slotted vertical tubes 16. The opposite flanges 86 engage the canted cam ears 66A and 66B, e.g., as seen in FIGS. 13 and 14, in a cam-action fastening technique. This draws the adjacent vertical surface of each tube 16 against the web 83 of the retainer post 62 by the cam-action, thereby providing a bottom interlock, as illustrated in FIG. 15. When the flanges 86 slide over the bottom horizontal bar 68 of the clip 60, the direct lateral abutment between the grooves and surface B provides a lock to prevent separation of the panels caused by lateral forces.

The post 62 conceals the locking clips 60 and the portions of tube 16 extending outward from the row of slots 17. The outer longitudinal flanges 88 of the post 62 engage the sides of the tube 16, thereby providing transverse stability. As shown in FIGS. 3 and 13–15, the clip 60 is partially recessed from the outer surface D of vertical tube 16. In this recessed arrangement, the vertical retainer post 62 further straddles the vertical tube 16, thereby providing greater transverse stability in the joining arrangement.

Figure 9:
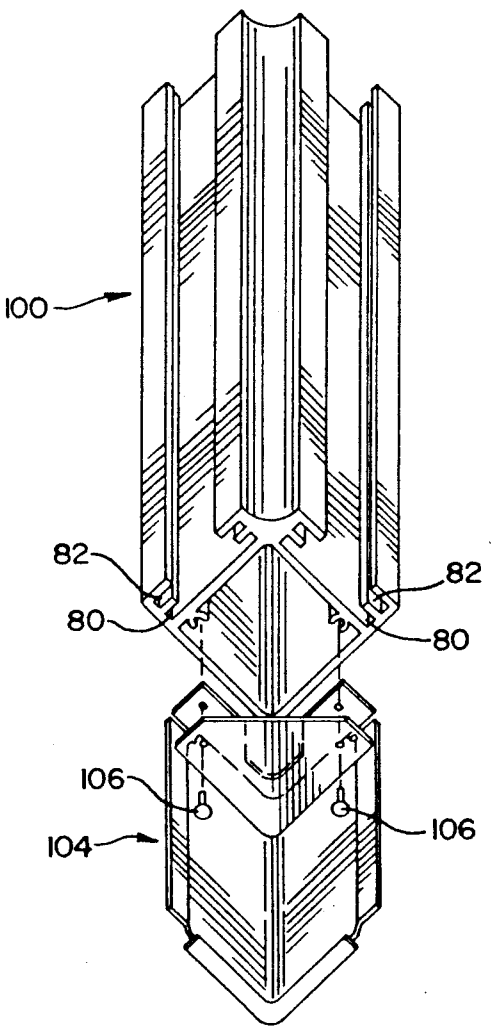
FIG. 9 is a perspective view of a vertical retaining post, with a base rail section, of the present invention for use in connecting two panels at a right angle.
Figure 8:
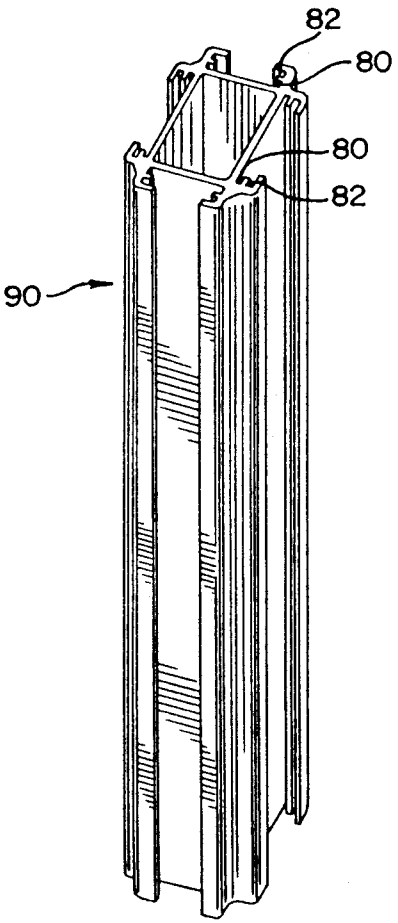
FIG. 8 is a perspective view of a vertical retaining post of the present invention for use in joining four panels in a cross configuration.

This panel interconnect system can be used to join a plurality of panels together. Two more examples of interconnect vertical posts are shown in FIGS. 8 and 9. FIG. 8 illustrates a cross vertical retainer post 90 which can be used to join four of the final assembly wall panels 10 together. As can be seen, the cross vertical post 90 has inner grooves 80, and outer grooves 82 and flanges 86, 88 at each four sides in accordance with the invention as previously described.

FIG. 9 illustrates a right angle vertical retainer post 100 for joining two of the final assembly wall panels 10 at a 90° angle with respect to one another. Also illustrated is a base rail transition 104 which is attached to the bottom of the right angle retainer post 100 by a plurality of screws or pins 106. In this embodiment, two of the pins 106 are used. The base rail transition 104 is used at the bottom of the right angle vertical retainer post 100 to fill in the space which is left between the kickplates 46 once two of the final assembly wall panels 10 are joined together. The base rail transition 104 can be configured to attach to any type of vertical retainer post but is necessary for filling in the space between kickplates when the right angle vertical retainer post 100 is used as opposed to the in-line post 62. It can also be used on a T-shaped vertical retainer post (not shown) used to connect three of the final assembly wall panels 10 at right angles with respect to one another.

Figure 10:
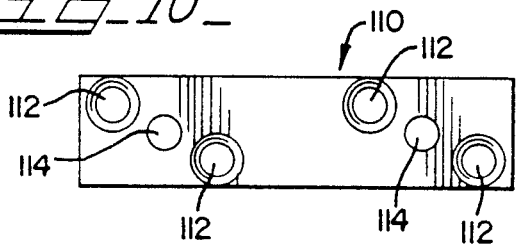
FIG. 10 is a top view of the horizontal stiffening plate shown in FIG. 1.

Once the final assembly wall panels 10 have been joined at the bottom by the vertical retainer post, a horizontal stiffening plate 110 is used to interlock the panel tops. As seen in FIG. 10, the horizontal stiffening plate 110 is used to connect the tops of panels in an inline fashion when the in-line post 62 is used. The horizontal stiffening plate 110 has two sets of three screw holes used for attaching the plate 110 to the horizontal tubes 14. The two outer holes 112 of each set of three holes are used as screw holes for attaching the horizontal stiffening plate 110 to each panel. A center hole 114 is used for attaching the cableway base 48 to the horizontal tube 14.

A variety of other horizontal stiffening plates are envisioned for connecting the tops of the final assembly wall panels 10. Their configuration will depend on how many and in what configuration the panels are joined. For instance, if the cross vertical post 90 is used to join four panels, a cross-shaped horizontal stiffening plate would be used. Such horizontal stiffening plates are well known in the art.

Figure 12:
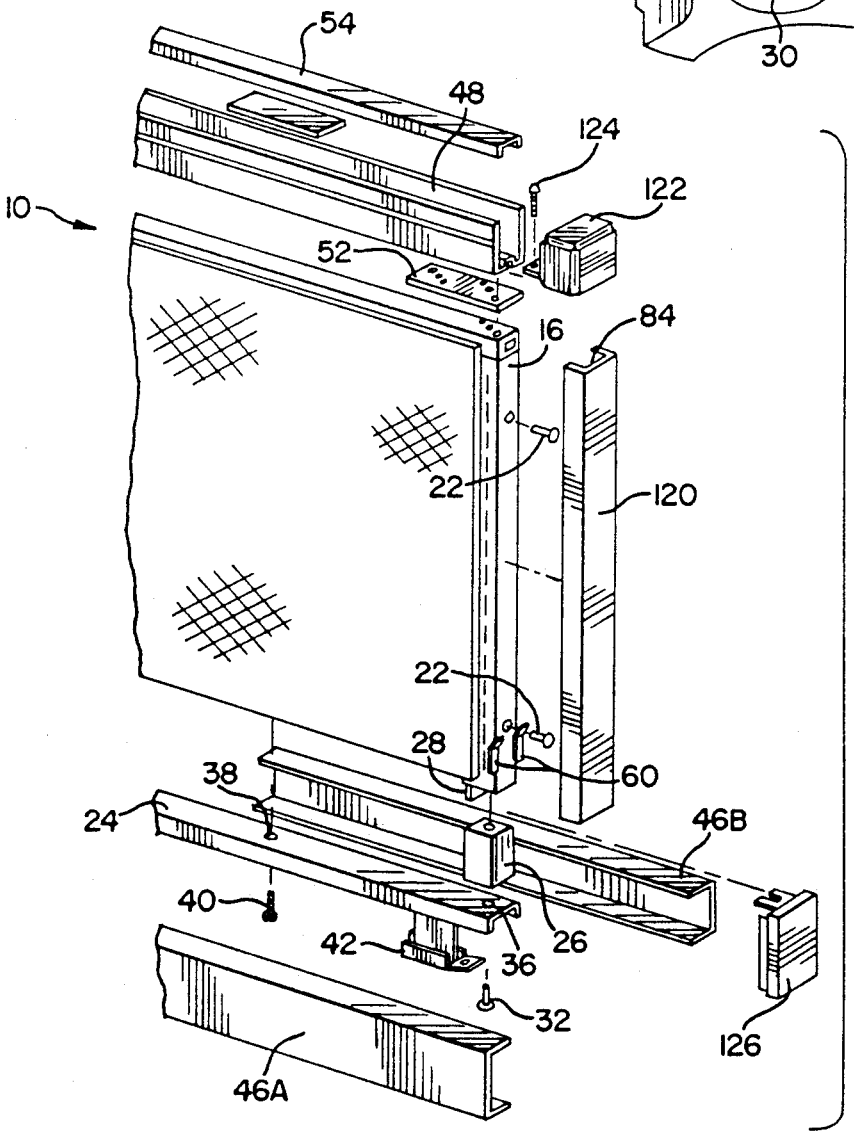
FIG. 12 is an exploded view of an end panel of the present invention.

As shown in FIG. 12, an end cap 120 is used to cover the exposed vertical face of the slotted tube 16 when no adjacent panel is attached. The end cap 120 has a single channel 84 on only one side with inner flanges 86 and 88 (not shown) within the channel 84 as previously discussed. The vertical end cap 120 provides an aesthetically pleasing covering for the exposed vertical faces of any of the tubes 16.

A cableway transition end cap 122 is attached to the horizontal tube 14 by an end cap screw 124. The cableway transition end cap 122 conceals the open end of the cableway base 48 when a vertical end cap 120 is used. A baserail transition end cap 126 conceals the open end at the bottom of the final assembly wall panel 10 created by the base rail 24 and the kick plates 46A and 46B.

The foregoing description of the invention has been presented for purposes of illustration and description. It is not intended to limit the invention to the precise forms disclosed, and obviously many modifications and variations are possible in light of the above teachings. For example, the retainer post could be fastened to one of the two panels. Then, one would only need to place a clip on the opposite panel. This, however, would create male and female ends, which is normally not desired. In addition, one could place the clips on the post 62. The center post 62 would then need to extend to the floor to support the post. The ends of the panel 16 would be constructed with channels 84 having inner flanges 86 and 88.

What is claimed is:

1. An arrangement for joining first and second partition members at adjacent substantially vertical side edges thereof, each such side edge having an upper portion adjacent the top of the partition member and a lower portion adjacent the bottom of the partition member, the arrangement comprising:

an elongated retainer post having a lower portion and a first connecting element affixed within said lower portion, said first connecting element including an aperture defined in the bottom end of said post, said retainer post being disposed between and in contact with the side edges of the first and second partition members, a second connecting element mounted on said first partition member adjacent one of said side edges and within said lower portion thereof, said second connecting element defining a cam surface disposed at an angle less than 40° relative to such vertical edges and exposed to and engageable with said first connecting element when said post and respect panel are assembled, whereby said first connecting element may engage said second connecting element in a cam-action fastening technique thereby drawing said first partition to said retainer post as said engagement occurs.

2. An arrangement for joining first and second partition members at adjacent substantially vertical side edges thereof, each such side edge having an upper portion adjacent the top of the partition member and a lower portion adjacent the bottom of the partition member, the arrangement comprising:

an elongated retainer post having a lower portion and a first connecting element affixed within said lower portion, said retainer post being disposed between and in contact with the side edges of the first and second partition members, a second connecting element mounted on said first partition member adjacent one of said side edges and within said lower portion thereof, said second connecting element defining a cam surface disposed at an angle less than 40° and greater than 5° relative to such vertical edges and exposed to and engageable with said first connecting element when said post and respective panel are assembled, said second connecting element including a second surface which is exposed to and engageable with the first connecting element, said second surface being elongated and parallel to said vertical axis of said first partition member for reducing the possibility of separation due to lateral forces, whereby said first connecting element may engage said second connecting element in a cam-action fastening technique thereby drawing said first partition to said retainer post as said engagement occurs.

3. An arrangement for joining first and second partition members at adjacent substantially vertical side edges thereof, each such side edge having an upper portion adjacent the top of the partition member and a lower portion adjacent the bottom of the partition member, the arrangement comprising:

an elongated retainer post having a lower portion and a first connecting element affixed within said lower portion, said retainer post being disposed between and in contact with the side edges of the first and second partition members, and said first connecting element including a set of grooves disposed in an aperture at the bottom end of said post, a second connection element mounted on said first partition member adjacent one of said side edges and within said lower portion thereof, said second connecting element defining a cam surface disposed at an angle less than 40° and greater than 5° relative to such vertical edges and exposed to and engageable with said first connecting element when said post and respective panel are assembled, said second connecting element includes a second surface which is exposed to and engageable with the first connecting element for reducing the possibility of separation due to lateral forces, a third connecting element on said second partition member, said third connecting element including a cammed surface and a second surface, said cammed surface canted between 5° and 40° outward from the vertical axis of said second partition member, and said post further including a fourth connecting element for engaging said post with said third connecting element, whereby said first connecting element may engage said second connecting element in a cam-action fastening technique thereby drawing said first partition to said retainer post as said engagement occurs.

4. A retainer post for use in joining partition members with clip elements, said post comprising:

an elongated member having an upper and a lower portion and a vertical opening which may straddle the side edge of such a partition member, said lower portion having an aperture at the bottom, said aperture including means for engaging said clip elements of said panels, and wherein said vertical opening includes a set of parallel, vertical grooves for engaging said partition members.

5. An arrangement for joining first and second partition members at adjacent substantially vertical side edges thereof, each such side edge having an upper portion adjacent the top of the partition member and a lower portion adjacent the bottom of the partition member, the arrangement comprising:

an elongated retainer post having a lower portion and a first connecting element affixed within said lower portion, said retainer post being disposed between and in contact with the side edges of the first and second partition members, a second connecting element mounted on said first partition member adjacent one of said side edges and within said lower portion thereof, one of said first and second connecting elements defining a cam surface disposed at a significant angle relative to such vertical edges and exposed to and engageable with the other of said connecting elements when said post and respective partition members are assembled, and said one connecting element also defining a second surface parallel to said vertical edges, said second surface exposed to and engageable with the other of said connecting elements when said post and respective partition member are assembled, wherein, relative to said cammed surface, said second surface reduces the possibility of separation of the post and partition member due to lateral forces.

6. The arrangement of claim 5 wherein said second surface is in direct lateral abutment with said first connecting element when said post and respective partition member are assembled.

7. An arrangement for joining first and second partition members at adjacent substantially vertical side edges thereof, each such side edge having an upper portion adjacent the top of the partition member and a lower portion adjacent the bottom of the partition member, the arrangement comprising:

an elongated retainer post having a lower portion and a first connecting element affixed within said lower portion, said retainer post being disposed between and in contact with the side edges of the first and second partition members, and said first connecting element including an aperture defined in the bottom end of said post, a second connecting element mounted on said first partition member adjacent one of said side edges and within said lower portion thereof, said second connecting element defining a cam surface disposed at a significant angle relative to such vertical edges and exposed to and engageable with the other of said connecting elements when said post and respective partition members are assembled, and said second connecting element also defining a second surface which is exposed to and engageable with said first connecting element when said post and respective partition member are assembled, wherein, relative to said cammed surface, said second surface reduces the possibility of separation of the post and partition member due to lateral forces.

* * * * *